US007665228B2

(12) United States Patent
Ricklefs et al.

(10) Patent No.: US 7,665,228 B2
(45) Date of Patent: Feb. 23, 2010

(54) FLOW ENHANCING AIR DUCT AND GRILL FOR LAUNDRY DRYER

(75) Inventors: Michael Paul Ricklefs, Webster City, IA (US); Brian Douglas Ripley, Webster City, IA (US); Bradley Steven Hoogendoorn, Webster City, IA (US)

(73) Assignee: Electrolux Home Products, Inc., Cleveland, OH (US)

( * ) Notice: Subject to any disclaimer, the term of this patent is extended or adjusted under 35 U.S.C. 154(b) by 0 days.

(21) Appl. No.: 11/960,364

(22) Filed: Dec. 19, 2007

(65) Prior Publication Data

US 2009/0158617 A1 Jun. 25, 2009

(51) Int. Cl.
*D06F 58/04* (2006.01)
*D06F 58/20* (2006.01)
*F26B 11/04* (2006.01)

(52) U.S. Cl. ..... 34/603; 34/595; 34/139

(58) Field of Classification Search ..... 34/79, 34/82, 595, 603, 134, 138, 140, 235
See application file for complete search history.

(56) References Cited

U.S. PATENT DOCUMENTS 3,099,542 A * 7/1963 Scoyk ..... 34/77
3,304,624 A 2/1967 Czech
3,471,940 A 10/1969 Smith
4,103,433 A * 8/1978 Taylor ..... 34/86
4,726,125 A 2/1988 Pellerin
4,899,464 A 2/1990 Carr et al.
5,317,816 A 6/1994 Kadakia
7,069,669 B2 7/2006 Park et al.

* cited by examiner

*Primary Examiner*—Jiping Lu
(74) *Attorney, Agent, or Firm*—Banner & Witcoff, Ltd.

(57) ABSTRACT

A flow enhancing air grill for a laundry dryer includes a plurality of apertures through which air flows from a rotatable drum to an air duct. The air grill is positioned over the air duct and extends beyond the air duct. In addition, a primary surface of the air grill is positioned in spaced overlying relationship to a front bulkhead surface so as to form a gap between the primary air grill surface and the underlying front bulkhead surface. The air grill may extend arcuately in conformance to the circular shape of an access port of the dryer in which it is positioned, up inclined wall surfaces of the access port. The arrangement reduces airflow obstruction by allowing adequate air flow in the event the portion of the air grill directly overlying the air duct inlet becomes covered by items of the laundry load.

15 Claims, 7 Drawing Sheets

FLOW ENHANCING AIR DUCT AND GRILL FOR LAUNDRY DRYER

TECHNICAL FIELD

This application deals with clothes dryers. More particularly, this application deals with air flow through a clothes dryer during operation and an air grill portion of the dryer associated with an air duct used to exhaust air from the drying chamber.

BACKGROUND

Today, the majority of households in America, and many around the world, have clothes dryers. In general, people have come to expect a certain level of performance from their dryers. Air flow through the dryer plays an important role in meeting these performance expectations.

Laundry dryer performance parameters such as drying time, temperature, noise levels, etc. depend largely on the characteristics of the air flow through the dryer. The air grill, air duct and lint blade all can influence these characteristics. During operation of a laundry dryer, any obstructions within the air flow path, such as clothes lodged on the air grill, may prevent proper airflow. In such instances, surging of the dryer may occur causing high noise levels and excessive loading of the blower motor (which may also serve to drive rotation of a drum of the dryer). In addition, drying time may be extended due to the irregular air flow, reduced tumbling action because of clothing becoming lodged on the air grill, etc. Providing a more consistent air flow through the dryer by reducing or eliminating air flow obstructions can provide improved performance.

Typically, the inlet to the duct employed to exhaust air from a dryer drum, and the overlying air grill, are arranged on a vertical or steeply inclined wall surface of the front bulkhead, below the access opening. To provide the necessary space for the duct inlet and grill thus may require the access opening to be raised to a higher position than may be optimal. This issue becomes more critical as the size (e.g., diameter and depth) of the dryer drum increases, as the size and position of the access opening will have a significant impact on the ability of a user to reach into, and access clothing or other items of the laundry load located in, the lower and rear portions of the drum.

SUMMARY

In accordance with an aspect of the present disclosure, a laundry dryer includes a front bulkhead and a rotatable drum mounted for rotation behind the front bulkhead. The front bulkhead includes an access port configured for providing access to the rotatable drum and having upwardly inclined side portions. The laundry dryer further includes an air duct for exhausting air from the rotatable drum and an air grill defining a plurality of apertures, arranged on the front bulkhead along a lower side of the access port and over an inlet of the air duct. The air duct inlet extends laterally along a lower side of the access port to a first lateral extent, and the air grill extends up at least one of the upwardly inclined side portions to a second lateral extent greater than the first lateral extent.

In another arrangement, the laundry dryer includes a rotatable drum. The housing includes a front bulkhead including an access port configured for providing access to the rotatable drum. An air duct for exhausting air from the rotatable drum is arranged within the access port and extends therealong to a first extent. The laundry dryer further includes an air grill arranged within the access port in overlying relation to the air duct and including an apertured surface. The air grill extends along the front bulkhead access port to a second extent exceeding the first extent in at least one dimension. Further, at least a portion of the apertured surface overlies a bulkhead surface defining the access port, in spaced relationship therewith, so as to form a gap between the apertured surface and the bulkhead surface to thereby provide a passage for air to flow from the drum to the air duct.

In yet another arrangement, the laundry dryer includes a rotatable drum and an air duct through which air flows to exit the dryer drum prior to being exhausted from the dryer. The laundry dryer further includes an air grill formed over the air duct. The air grill may include a first air grill portion forming a first plurality of air grill apertures positioned in overlying relationship with the air duct, and a second air grill portion forming a second plurality of air grill apertures positioned beyond the air duct in overlying relationship with a surface portion of the dryer which is directly exposed to an interior of the rotatable drum during dryer operation. In such an arrangement, a pathway for air flow from the drum to the air duct is formed between the second air grill portion and the surface portion such that an obstruction of the first plurality of air grill apertures does not prevent air from flowing from the drum through the second plurality of apertures to the air duct.

These and additional aspects, features and advantages of the invention disclosed herein will be further understood from the following detailed description.

BRIEF DESCRIPTION OF THE DRAWINGS

The foregoing summary, as well as the following detailed description of illustrative embodiments, is better understood when read in conjunction with the accompanying drawings, which are included by way of example, and not by way of limitation with regard to the claimed invention.

DETAILED DESCRIPTION

The following discussion and accompanying figures disclose a flow enhancing air duct and grill arrangement for use in a laundry dryer. The arrangement may be used with various types of laundry dryers that rely upon a flow of air to generate a drying action. This includes both gas heat dryers and electric heat dryers, open dryer systems that exhaust air from the dryer, as well as closed or air recirculating/condenser dryers.

Figure 1:
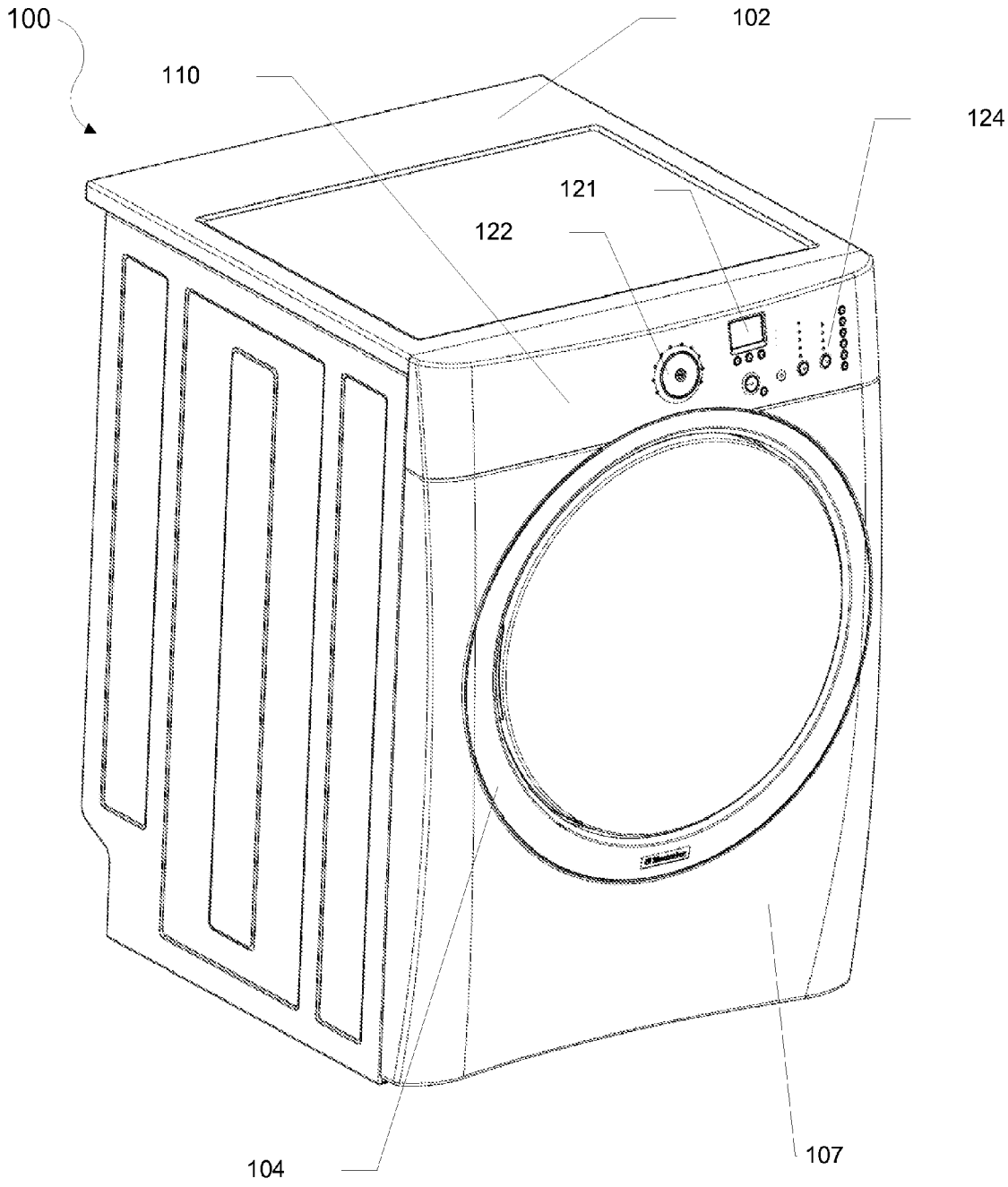
FIG. 1 is a frontal perspective view of a laundry dryer that may be provided with the flow enhancing air grill and duct arrangement described herein.

An illustrative laundry dryer 100 is shown in FIG. 1. This laundry dryer includes a housing 102 and a rotatable drum 108 within the housing for containing and tumbling a laundry load during dryer operation. A circular port hole-style door 104 covers an access port for providing access to the rotatable drum 108. The dryer further includes a control panel 110, that may include one or more knobs, such as knob 122, push-buttons 124, lighted indicia and the like that allow a user to select various drying cycles or drying cycle parameters such as drying time, temperature, etc. In addition, the user interface may include a display screen 121, such as a liquid crystal display (LCD), for indicating various cycle parameter settings. It will be understood that the dryer includes appropriate components for carrying out basic dryer operational tasks. Such components will typically include control electronics, a drive system for rotation of the drum, such as a motor-driven belt drive system, and a fan or blower for circulating air through the dryer.

Figure 2:
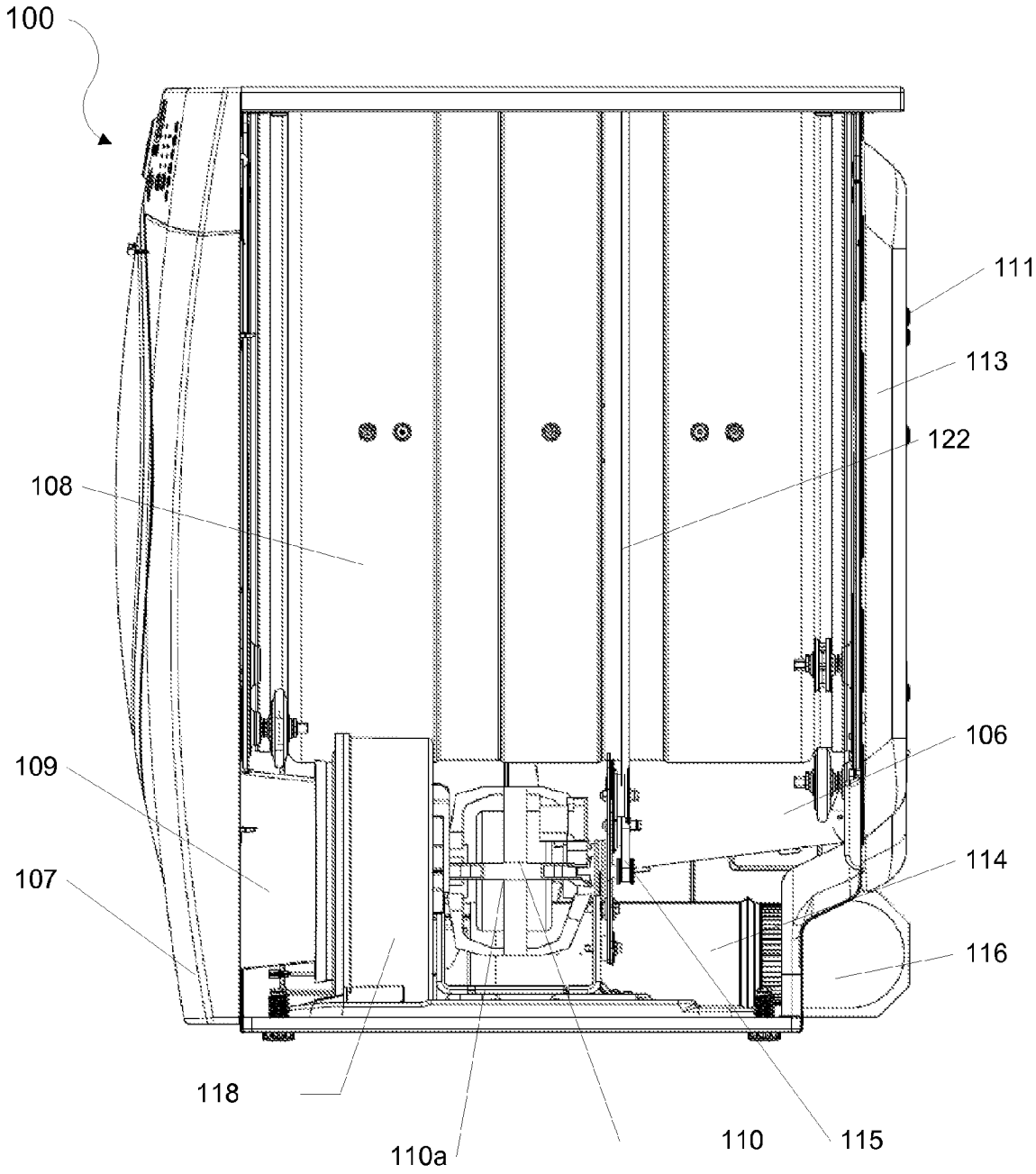
FIG. 2 is a side elevational view of the illustrative dryer of FIG. 1, with the side panel removed to show internal components.
Figure 3:
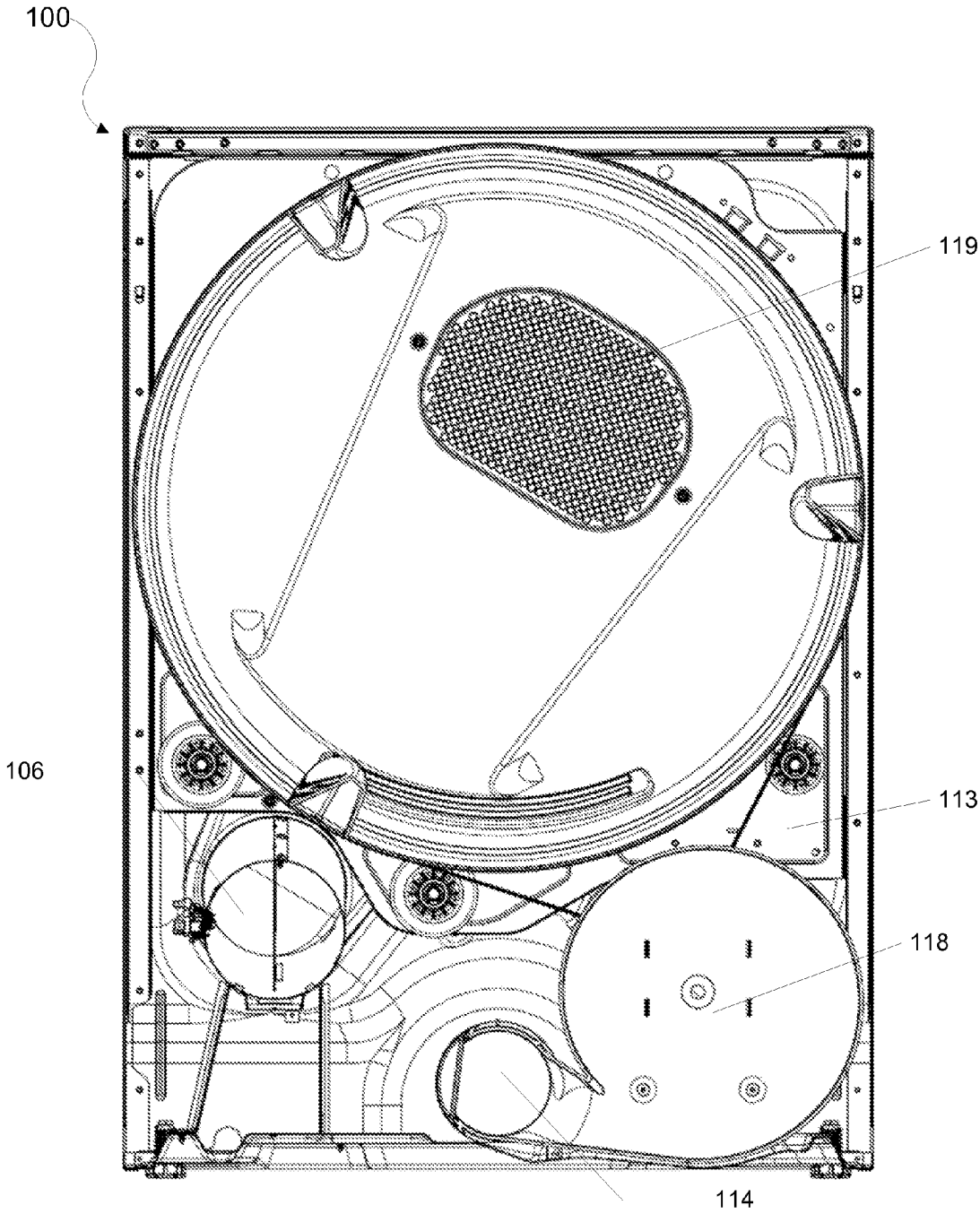
FIG. 3 is a front elevation view of the illustrative dryer with the front panel removed to show internal components.

Housing 102 generally contains such electrical and mechanical systems for typical dryer function. For example, referring to FIGS. 2 and 3, a canister-type heater 106 is positioned below a rotatable drum 108 in which clothes are contained and tumbled during a dryer cycle. Air is drawn through the heater canister from within the cabinet and the heated air is introduced to the rotatable drum 108 through an inlet duct 111 extending along a back side of, and passing through, a rear bulkhead 113 at a rear side of the drum. The opening 119 of the inlet duct 111 to the drum 108 is seen in FIG. 3. The air exits the drum 108 from a front side of the drum through a duct 109. The dryer further includes a drive system 110 configured to rotate the rotatable drum 108. The drive system 110 includes a motor 110*a* that rotates the drum 108 via a belt 122 and a drive pulley 115. In the arrangement shown, the motor is also used to drive the blower 118 which creates a vacuum to pull air through the dryer system. On its downstream side, blower 118 is connected with an exhaust tube 114 that connects with an external vent tube 116 for exhausting air from the dryer.

Figure 4:
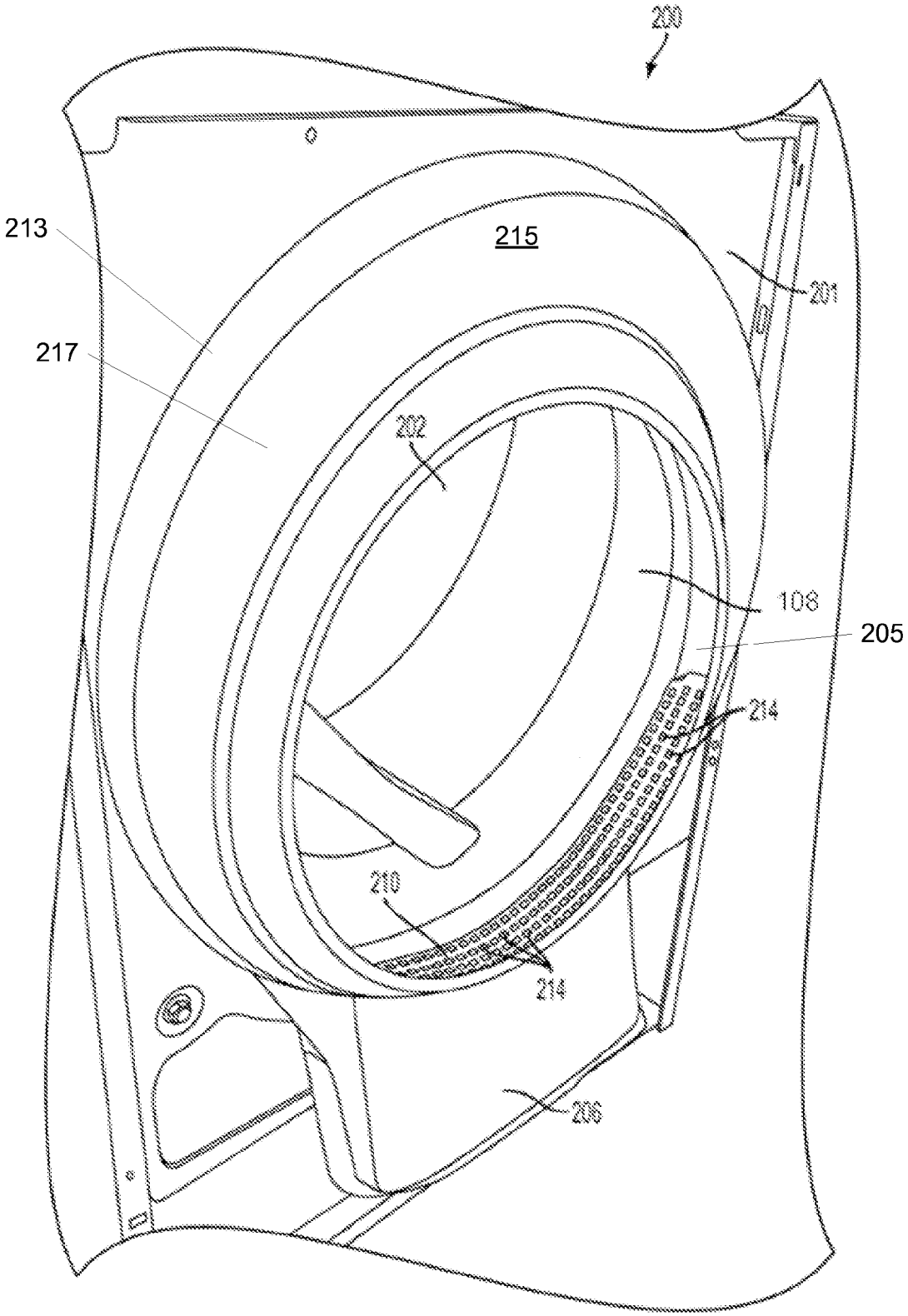
FIG. 4 is a frontal partial perspective view of the front of the clothes dryer of FIG. 1 with a front panel removed and showing a front bulkhead including a flow enhancing exhaust duct and air grill assembly as described herein.
Figure 6:
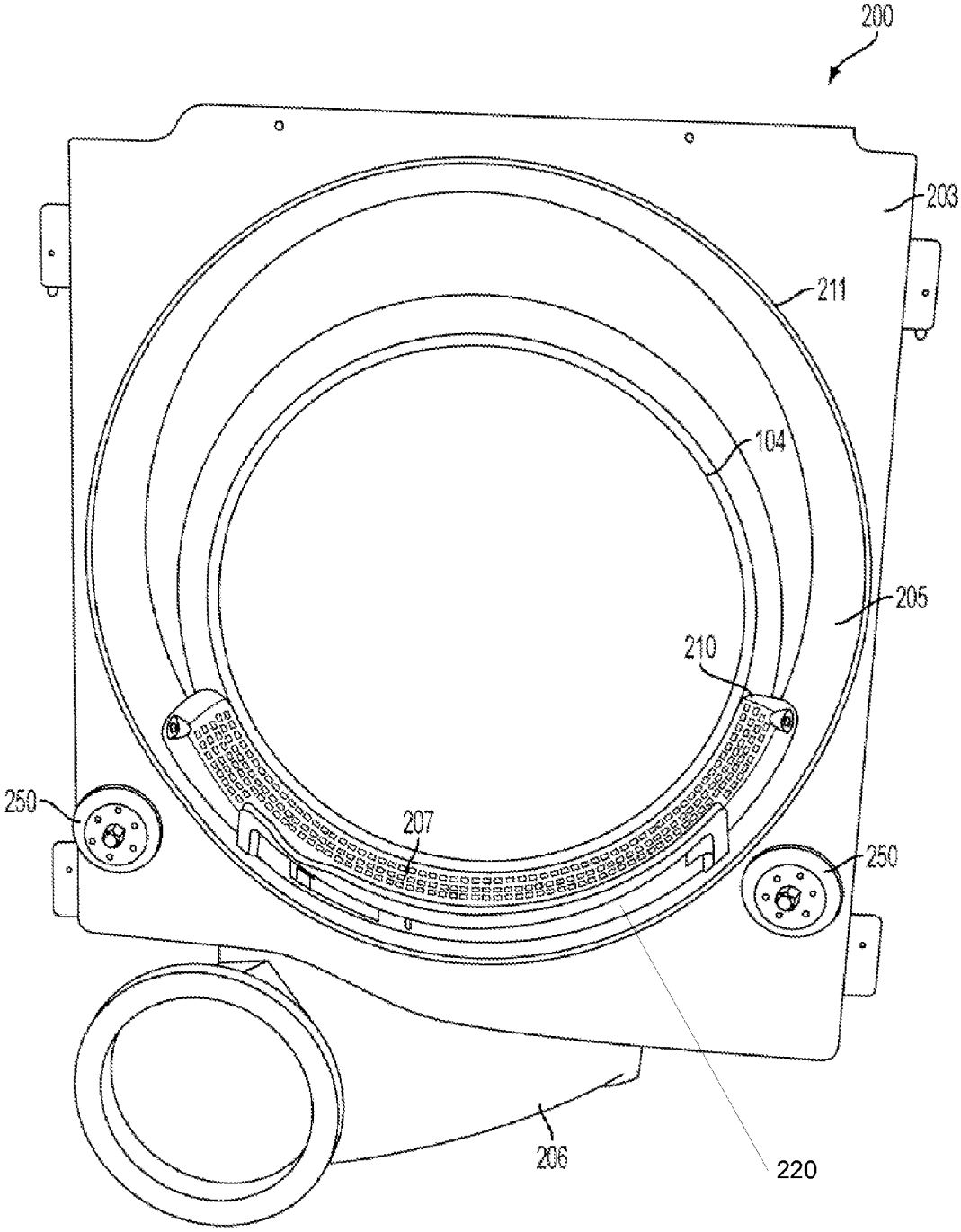
FIG. 6 is a rear perspective view of the front bulkhead shown in FIGS. 2 and 4, including the flow enhancing air duct and grill arrangement.

The housing 102 may include a front panel 107 that forms a face of the dryer. The front panel 107 generally covers a front bulkhead that provides, on its backside, a rotatable support for the dryer drum. Additionally, the bulkhead may incorporate components such as an air duct for receipt of exhaust air from the drum, an air grill covering an inlet of the air duct, and a lint trap or screen positioned within the air duct across the pathway. With reference now to FIGS. 4 and 6, the front bulkhead 200 includes a front side 201 (FIG. 4) that faces front panel 107 (FIG. 1) and a rear side 203 (FIG. 6) that faces rotatable drum 108. The rear side 203 may include a pair of rollers 250 for rotatably supporting the front end of rotatable drum 108.

The front bulkhead 200 generally defines an access port 202 for providing access to the interior of rotatable drum 108. Front bulkhead 200 incorporates an air duct structure 206 through which air flows to exit the drum. The air duct 206 may include a lint trap or screen extending across the airflow pathway to catch lint or other particles in the airflow before the airflow reaches the blower and the exhaust tube or vent downstream therefrom. In FIG. 6, a lint screen handle 220 is visible and has the screen attached therebelow for removable placement within the front bulkhead. The front bulkhead 200 also includes an air grill 210 positioned over an inlet of the air duct 206. The air grill 210 may include a plurality of apertures 214 of any suitable size and shape permitting air to flow substantially freely therethrough as it passes from the rotatable drum 204 to the air duct 206. The air grill 210 may be provided on a generally cylindrical bulkhead surface 205 defining the access port 202. Surface 205 generally extends depth wise of the dryer parallel to the interior cylindrical surface of rotatable drum 204 (and its horizontal axis of rotation). In one arrangement, the air grill 210 is configured such that its primary apertured surface is spaced from (e.g., elevated above) the bulkhead 200 such that a gap exists between the primary surface of the air grill and the underlying surface of the bulkhead defining the access opening. That is, the primary apertured air grill surface 207 is spaced from the supporting the bulkhead surface toward the center of the front bulkhead clothes access port 202, with only a supporting circumferential edge 209 of the air grill 210 in contact with the bulkhead 200 in order to connect the air grill 210 to the bulkhead 200. The air grill 210 may be formed of any suitable material and method, including injection molded plastic such as polypropylene. The air grill 210 may generally be fastened using any known fastening means, such as screws, bolts, and the like. In one arrangement, the air grill 210 is fastened with screws extending through the top of the air grill 210 and into the bulkhead. In some arrangements, alignment tabs are provided to aid in alignment of the air grill 210 with the air duct and screws may be provided at the end of those alignment tabs.

In the illustrated arrangement wherein the grill is mounted on a lower central portion of surface 205, primary grill surface 207 is elevated above the underlying portion of surface 205 to provide a gap (S in FIG. 7) between the primary surface of the air grill 210 and the underlying surface 205. In some arrangements, this gap S may be between 0.1 and 1.5 inches. In one particular arrangement, the gap may be approximately ⅜ inch. This spacing of the primary air grill surface 207 away from the surface of the bulkhead 200 provides an airflow enhancing pathway for air to flow from drum 108 into duct 206, as will be discussed below.

Figure 5:
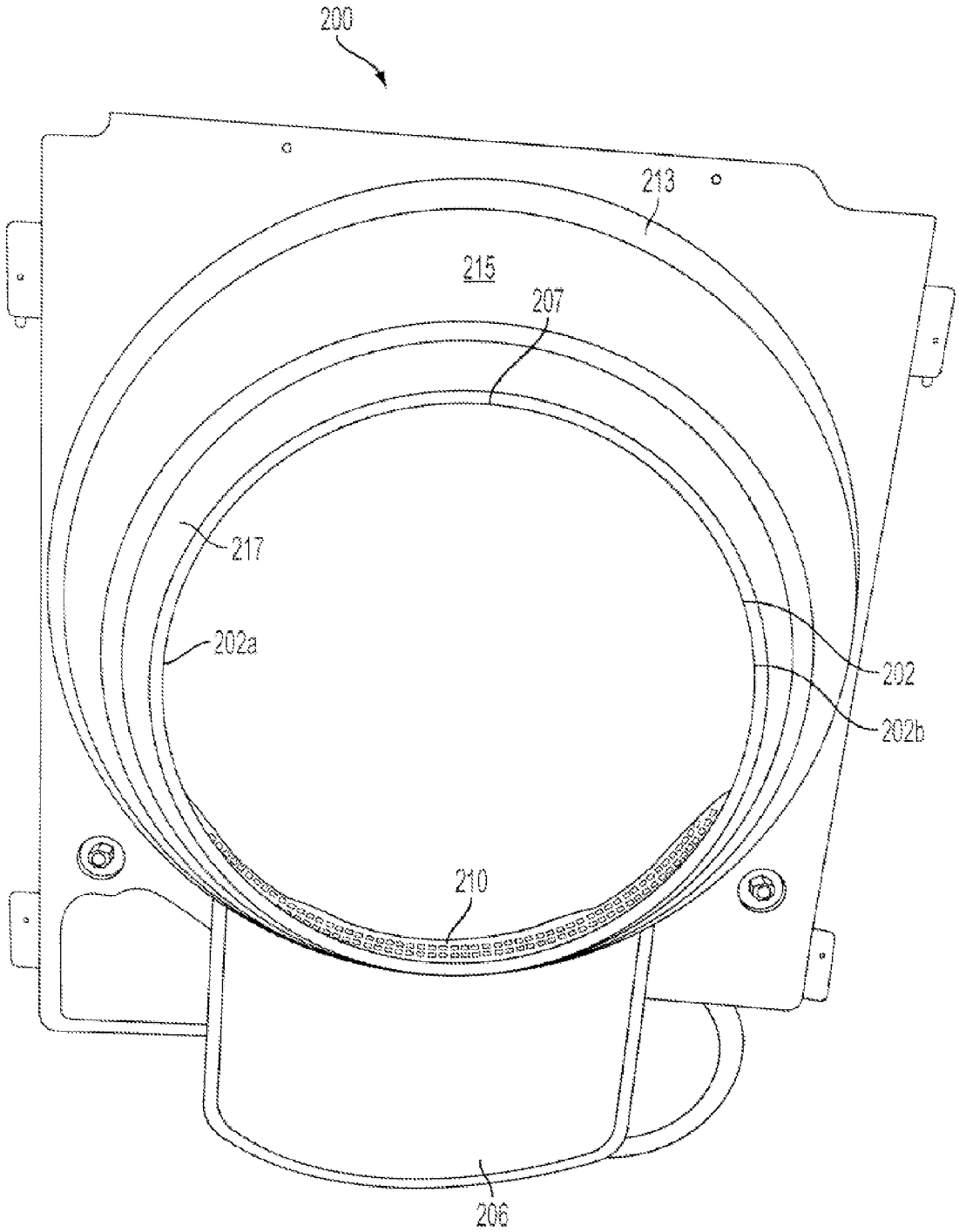
FIG. 5 is a front perspective view of the front bulkhead, exhaust duct and air grill assembly of FIG. 2.

The air grill 210 shown in FIGS. 4-6 generally follows the shape of access port 202. In particular, the air grill 210 may be a semi-circular arcuate shape following the circular arc of the lower portion of bulkhead surface 205 defining the access port. As shown, the air duct 206 and air grill 210 are positioned at a central, lower portion of the front bulkhead clothes access port 202, and the air grill 210 extends well beyond the underlying inlet of air duct 206, on both sides of the inlet. That is, the long dimension or lateral extension ($E_2$ in FIG. 7) of the air grill 210 is greater than the corresponding long dimension or lateral extension ($E_1$ in FIG. 7) of the inlet of air duct 206. In conjunction with the elevated positioning of the primary space surface 207 of the grill relative to the underlying bulkhead surface 205, such an arrangement allows for improved air flow.

As previously described, the air grill 210 is arranged such that it extends laterally, i.e., circumferentially, well beyond the ends of the inlet of air duct 206 and up the arcuate sides 202*a*, 202*b* of the access port 202. While the air grill 210 and the associated air duct are shown positioned at a central, lower portion of the access port 202 and the air grill extends in both directions, up the sides 202*a*, 202*b* of the port 202, well beyond both ends of the air duct inlet, other arrangements could also be implemented, such as placement of the air grill and duct on the sides or possibly even the above the access port, and/or in an asymmetrical arrangement wherein the air grill extends beyond the air duct inlet on only one side (or more on one side than the other). In some arrangements, the air grill may extend to a point on each side of the access port 202 between 0° and 90° from a central, bottom point.

Figure 7:
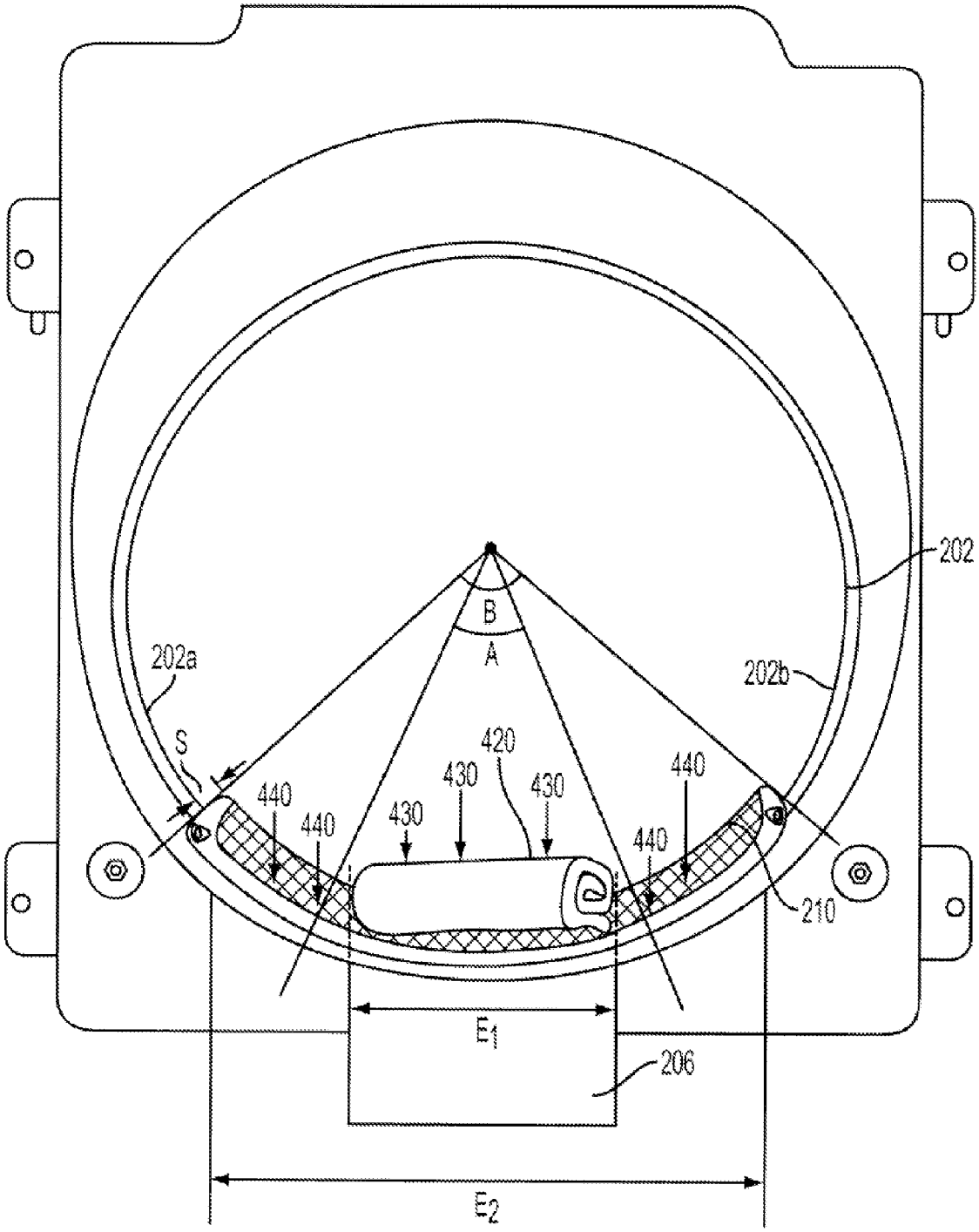
FIG. 7 is a schematic view illustrating air flow through the flow enhancing air duct and grill.

Benefits realizable with the inventive arrangement are now explained with reference to FIG. 7. Angle A represents the arc of the front bulkhead access port occupied by the inlet of air duct 206. Angle B represents the greater arc of the access port occupied by the air grill 210. In the illustrated embodiment, angle A is generally dictated by the width of the air duct, $E_1$ in FIG. 7. In the illustrated arrangement, angle B may be any angle greater than angle A and, in some arrangements angle B may be as large as 180°.

During a typical dryer cycle, clothes are tumbled within the rotatable drum. As the clothes are tumbling, one or more articles of clothing 420 may land on the air grill, as shown in FIG. 7. Article(s) of clothing 420 may remain on the air grill 210 drawn by the suction generated by the blower, until another tumbling article of clothing dislodges it. In a conventional system, during the time that an article of clothing is positioned over the air grill, air flow through the air grill may be substantially restricted. Such restriction will reduce airflow and hence adversely affect performance of the dryer. In addition, the air flow obstruction may cause a surging noise leading to an undesirable increase in the overall noise generated by dryer operation.

On the other hand, the air grill 210 facilitates continuous unobstructed air flow. For instance, should an article of clothing 420 become lodged on the air grill 210, as shown in FIG. 7, it would likely be positioned at a lower portion of the air grill 210. Generally, gravity would tend not to allow an article of clothing to remain adhered along inclined portions of the air grill 210 extending up sides 202*a*, 202*b*. The extension of air grill 210 beyond the air duct 206 and up the inclined arcuate sides 202*a*, 202*b* of access port 202, in conjunction with the spacing of the primary apertured surface of the grill from the underlying bulkhead surface, permits air flow even when a significant central portion of the air grill 210 is obstructed. For instance, although a portion of the air grill 210 is obstructed in FIG. 7, i.e., air flow shown by arrows 430 cannot pass through the air grill 210 into the air duct 206, a substantial portion of the air grill 210 remains open and permits air flow, as indicated by air flow arrows 440. This arrangement permits air to flow around and underneath an item of clothing adhered to a central portion of the grill, through the channel or flow path formed between the air grill and the bulkhead surface, until the article of clothing is removed. In addition, it provides a smoother (and less noisy) air flow throughout the drying process since the obstruction(s) will not cause a corresponding air surge in the dryer.

In addition, the provision of airflow pathways that remain unobstructed can advantageously equalize the pressure on opposite sides of the grill to thereby reduce or eliminate a vacuum effect tending to adhere laundry items to the grill. Still further, the inventive air grill arrangement can provide improved air flow without requiring an increase in size of the air duct inlet, thus allowing better use to be made of the limited space in the front bulkhead through which the air duct extends. By arranging the air duct inlet and overlying grill within the depthwise extending cylindrical surface area of the bulkhead which defines the access port, rather than on a back side of the front bulkhead, below the access port, it is possible to arrange the access port lower in relation to the rotatable drum, to thus improve user access to lower and rearward portions of the drum that might otherwise be difficult to access (especially as the relative size of the drum is increased). For example, referring to FIGS. 5 and 6, it will be seen that circular access port 202 is arranged eccentrically lower than the rotatable drum 108 (and with respect to the circular lip or rib 211 (FIG. 6) on the backside of the front bulkhead, which generally corresponds to the drum diameter). Referring to FIG. 6, smooth rotation of the drum on supporting rollers 250 may be facilitated by fitting the drum on circular lip or rib 211.

Referring to FIGS. 4-6, the inlet of air duct 206, and overlying grill 210, are accommodated within the lower portion of the generally horizontally oriented cylindrical surface 205. Surface 205 is an interior surface of a ring-like cylindrical portion of bulkhead 201 extending depthwise out from a vertically oriented tapering annular (generally crescent shaped) vertical bulkhead panel 215, i.e., the cylindrical surface defining the drum access port 202. Panel 215 extends generally vertically between relatively small diameter cylindrical portion 217 and a relatively larger diameter cylindrical portion 213 extending depthwise out of a generally planar panel portion of bulkhead 201. The diameter and orientation of cylindrical portion 213 generally corresponds to that of the drum 108. Portion 215 exhibits a crescent shape due to the eccentric arrangement of cylindrical portions 213 and 217. The illustrative eccentric arrangement also provides a merger of the inner surfaces of cylindrical portions 213 and 217 at the lower side, providing a composite depthwise width of surface 205 within which the inventive air duct/grill arrangement may be accommodated. The horizontal orientation of cylindrical surfaces 213 and 217 parallels that of rotatable drum 108.

In the illustrated embodiment, the spacing or gap formed between the portions of the air grill that extend beyond the air duct inlet form supplemental airflow channels or pathways for air to flow from the drum and into the air duct, not withstanding coverage of the duct inlet with laundry items. In lieu of an elevational spacing of the primary apertured surface portion of the grill with respect to the underlying bulkhead surface, other approaches for providing air flow pathways between these elements could be used, e.g. channels or recesses formed in the bulkhead surfaces underlying the grill.

In light of the foregoing disclosure and description of various arrangements, those skilled in this area of technology will readily understand that various modifications and adaptations can be made without departing from the scope and spirit of the invention. All such modifications and adaptations are intended to be covered by the following claims.

What is claimed is

1. A laundry dryer, comprising:

a front bulkhead;

a rotatable drum mounted for rotation behind the front bulkhead, wherein the front bulkhead includes an access port configured for providing access to the rotatable drum and having upwardly inclined side portions;

an air duct for exhausting air from the rotatable drum; and an air grill arranged on and overlaying a supporting surface of the front bulkhead, in spaced relationship therewith, the air grill having a primary surface defining a plurality of apertures, the primary surface being spaced from the supporting surface inwardly toward a center of the access port to thus form a gap between the air grill and the front bulkhead, along a lower side of the access port and over an inlet of the air duct;

wherein the air duct inlet extends laterally along a lower side of said access port to a first lateral extent, and the air grill extends up at least one of said upwardly inclined side portions to a second lateral extent greater than said first lateral extent.

2. The laundry dryer of claim 1, wherein said lower side of the access port comprises a segment of a surface extending depthwise of the dryer generally parallel to a surface of said rotatable drum.

3. The laundry dryer of claim 1, wherein the air grill is arcuately shaped to generally follow an acruate supporting surface of the bulkhead.

4. The laundry dryer of claim 1, wherein the air grill is directly exposed to an interior of the rotatable drum during dryer operation.

5. A laundry dryer, comprising:

a rotatable drum and a front bulkhead, the front bulkhead including an access port configured for providing access to the rotatable drum and an air duct for exhausting air from the rotatable drum, said air duct being arranged within said access port and extending therealong to a first extent;

an air grill, arranged within the access port in overlying relation to said air duct, the air grill having a primary apertured surface spaced from the air duct inwardly toward a center of the access port, wherein the air grill extends along the access port to a second extent exceeding the first extent in at least one dimension, and wherein at least a portion of the primary apertured surface of the air grill overlies a bulkhead surface defining said access port, in spaced relationship therewith, so as to form a gap between the apertured surface and said bulkhead surface to thereby provide a passage for air to flow from said drum to said air duct.

6. The laundry dryer of claim 5, wherein said second extent exceeds said first extent in a lateral dimension.

7. The laundry dryer of claim 6, wherein the air grill extends laterally up an inclined portion of said front bulkhead surface defining the access port.

8. The laundry dryer of claim 7, wherein the inclined portion of the access port is an arcuately extending surface portion.

9. The laundry dryer of claim 7, wherein the inclined portion further extends depthwise of the dryer generally parallel to a surface of said rotatable drum.

10. The laundry dryer of claim 5, wherein the air grill extends along a lower side of the access port.

11. The laundry dryer of claim 5, wherein the air grill is arcuately shaped to generally follow an acruate supporting surface of the bulkhead.

12. The laundry dryer of claim 5, wherein the air grill is directly exposed to an interior of the rotatable drum during dryer operation.

13. A laundry dryer, comprising:

a rotatable drum;

an air duct through which air flows to exit the rotatable drum prior to being exhausted from the dryer;

an air grill formed over the air duct and being located so as to be contactable by dryer load items tumbling in the rotatable drum during dryer operation, the air grill including:

a first air grill portion forming a first plurality of air grill apertures positioned in overlying relationship with the air duct; and a second air grill portion forming a second plurality of air grill apertures positioned beyond the air duct in overlying relationship with a surface portion of the dryer which is directly exposed to an interior of the rotatable drum during dryer operation, wherein a pathway for air flow from the drum to the air duct is formed between the second air grill portion and said surface portion, such that an obstruction of the first plurality of air grill apertures by dryer load items does not prevent air from flowing from the drum through the second plurality of apertures to the air duct.

14. The laundry dryer of claim 13, wherein the air duct incorporates a lint trap therein.

15. The laundry dryer of claim 13, wherein the air grill overlays a supporting surface of a front bulkhead of the dryer and has a primary surface spaced from the supporting surface inwardly toward a center of an access portion formed in the front bulkhead.

* * * * *